United States Patent [19]

Plapper et al.

[11] 4,264,319

[45] Apr. 28, 1981

[54] WATER-INSOLUBLE ALUMINOSILICATES IN THE MANUFACTURE OF LEATHER

[75] Inventors: Juergen Plapper, Hilden; Klaus Schumann, Erkrath; Emanuel Arndt, Düsseldorf; Emil Ruscheinsky, Leverkusen, all of Fed. Rep. of Germany

[73] Assignee: Henkel Kommanditgesellschaft auf Aktien, Düsseldorf-Holthausen, Fed. Rep. of Germany

[21] Appl. No.: 56,355

[22] Filed: Jul. 10, 1979

[30] Foreign Application Priority Data

Jul. 20, 1978 [DE] Fed. Rep. of Germany ..... 2831846

[51] Int. Cl.[3] ..... C14C 3/06; C14C 3/04; C14C 3/08; C14C 3/22

[52] U.S. Cl. ..... 8/94.26; 8/94.25; 8/94.27; 8/94.29

[58] Field of Search ..... 8/94.29, 94.27, 94.26, 8/94.25

[56] References Cited

U.S. PATENT DOCUMENTS

| | | | |
|---|---|---|---|
| 2,395,472 | 2/1946 | Fernald et al. | 8/94.19 |
| 3,792,976 | 2/1974 | Erdmann et al. | 8/94.27 |
| 3,870,464 | 3/1975 | Briggs | 8/94.29 |
| 4,049,379 | 9/1977 | Erdmann et al. | 8/94.29 |
| 4,126,413 | 11/1978 | Traubel et al. | 8/94.26 |

OTHER PUBLICATIONS

Derwent Abst. 01896B/02 Dec. 12, 1978 Henkel (BE-868-481) "Use of Alkali Metal Aluminosilicates for Cleaning Crude Skins".

Derwent Abst. 10088B/06 Feb. 1, 1979 Henkel (DT 2732-217) "Additives for Defatting & Tanning in Leather Manuf.".

Chem. Abs. 20430t vol. 69 (1968) "Increasing the Water Resistance of Hides".

*Primary Examiner*—Joseph L. Schofer
*Assistant Examiner*—Herbert J. Lilling
*Attorney, Agent, or Firm*—Hammond & Littell, Weissenberger and Muserlian

[57] ABSTRACT

In an improved process of tanning for the production of leather comprising subjecting pickled uncured hides to the action of an aqueous liquor containing (1) chemical tanning or pretanning agents and (2) auxiliary chemicals to tanning and recovering leather, the improvement consisting essentially of employing (i) a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof; n represents an integer of from 1 to 3; x is a number of from 0.5 to 1.8; and y is a number of from 0.8 to 50, said aluminosilicates having an average particle size in the range of from about 0.1μ to 5 mm and a calcium binding power of from about 0 to 200 mg CaO/gm of anhydrous active substance measured at 22° C. according to the Calcium Binding Power Test Method, and (ii) carboxylic acids having at least two carboxyl groups and containing ester groups and/or urethane groups and/or amide groups, said carboxylic acids having a molecular weight of from about 200 to 30,000 and being water-soluble or water-dispersible, as partial replacement of said chemical tanning or pretanning agents and said auxiliary chemicals to tanning.

27 Claims, No Drawings

WATER-INSOLUBLE ALUMINOSILICATES IN THE MANUFACTURE OF LEATHER

FIELD OF THE INVENTION

This invention is directed to an improved process for the production of leather. More specifically, this invention is directed to a process of tanning leather whereby water-insoluble aluminosilicates and carboxylic acids are employed.

BACKGROUND OF THE INVENTION

One of the most pressing problems in the manufacture of leather is the partial or complete replacement of auxiliary agents, which place a great strain on the waste water systems of factories. This is the case especially with regard to the tanning of fur skins and leather, as well as the defatting and the pretanning of skins smoothed by pickling. In addition to tanning agents, other auxiliary agents, such as solvents, defatting agents, tensides, electrolytes, phosphates, neutralizers, etc., are used in the processes of leather manufacture.

OBJECTS OF THE INVENTION

It is an object of the present invention to provide an improved process of tanning for the production of leather.

It is also an object of the present invention to provide an improved process of defatting and pretanning of pickled dehaired hides comprising subjecting pickled dehaired hides to the action of an aqueous liquor containing (1) surface-active compounds selected from the group consisting of anionic surface-active compounds and nonionic surface-active compounds, (2) electrolytes, and (3) sequestering agents, rinsing and recovering defatted pretanned hides.

A further object of the present invention is the improvement in the process of tanning uncured hides comprising subjecting uncured hides to the action of an aqueous liquor containing basic metal salt tanning agents, and tanning auxiliaries for a time sufficient to tan said hides, rinsing and recovering leather.

A yet further object of the invention is the reduction of the use of chemicals and the strain on waste water systems during the manufacture of leather.

These and other objects of the present invention will become more apparent as the description thereof proceeds.

DESCRIPTION OF THE INVENTION

This invention is directed to the reduction of the application of chemicals for leather production and to the reduction of the load on sewage waters from leather production. For this purpose, according to the invention, specified alumino-silicates and carboxylic acids are used, which are capable of partially or completely replacing the customarily used auxiliary agents and which, because of their ecological safety and acceptability, result in a considerable improvement of the sewage water situation. The reduction of chemicals is achieved by the use of (i) water-insoluble, preferably bound-water containing, aluminosilicates of the general formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof; n represents an integer of from 1 to 3 of the valence of the cation; x is a number of from 0.5 to 1.8; and y is a number of from 0.8 to 50, said aluminosilicates having an average particle size in the range of from about 0.1$\mu$ to 5 mm and a calcium binding power of from about 0 to 200 mg CaO/gm of anhydrous active substance measured at 22° C. according to the Calcium Binding Power Test Method, and (ii) carboxylic acids having at least two carboxyl groups and containing ester groups and/or urethane groups and/or amide groups, said carboxylic acids having a molecular weight of from 200 to 30,000 and being water-soluble or water-dispersible. The calcium binding power is determined according to the Calcium Binding Power Test Method set forth below in the Examples. Preferably y is a number from 1.3 to 20.

More particularly, the present invention relates to the improvement in the process of tanning for the production of leather comprising subjecting pickled uncured hides to the action of an aqueous liquor containing (1) chemical tanning or pretanning agents, and (2) auxiliary chemicals to tanning and recovering leather. The improvement consists essentially of employing a water-insoluble aluminosilicate, containing bound-water, of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof; n represents an integer of from 1 to 3; x is a number of from 0.5 to 1.8; and y is a number of from 0.8 to 50, said aluminosilicates having an average particle size in the range of from about 0.1$\mu$ to 5 mm and a calcium binding power of from about 0 to 200 mg CaO/gm of anhydrous active substance measured at 22° C., and the carboxylic acids described herein, as partial replacement of said chemical tanning or pretanning agents and said auxiliary chemicals to tanning.

The most important type of tanning is chrome tanning. It is based on the azido-complex formation and the agglomeration of basic chrome salts with collagen carboxyl groups.

In addition, other basic metal salts such as of iron, aluminum, zirconium, titanium and silicon, have tanning properties. In practice, however, only specified aluminum and zirconium salts have been used as combination tanning agents. Silicon compounds practically have not been used at all because of the raw materials, mostly special waterglasses, i.e., sodium silicates, are difficult to handle in an acidic tanning medium. Additionally, the leather quality in most cases, especially after mellowing, is inferior because hardening, brittle feel, and loss of resistance to tearing can occur.

The application of aluminosilicates in combination with the carboxylic acids described herein, specifically to chrome tanning and/or combination tanning with chrome, aluminum, and silicon tanning agents, produces the following advantages:

A considerable lightening of the burden on the tannery waste waters is achieved by a reduction of the amount of chrome tanning agents as well as by a very high consumption of chrome from the tanning liquors, where a reduction of the residual chrome content in the liquor to as low as 0.2 gm/l of chromic oxide can be reached. The use of the aluminosilicates alone leads to a considerable reduction of the residual chrome content in the liquor; however, this situation can be greatly improved by the combination of the aluminosilicates with the carboxylic, i.e., polycarboxylic, acids described herein. This high consumption of chrome from the tanning liquors also results in a more economical use of the chrome tanning agents as well as relief of the waste water.

The ability to penetrate the skins and the distribution of the combination tanning agents in them are increased while the disadvantages of the regular silicon tanning agents are avoided, because the aluminosilicates dissolve into sodium salts, aluminum salts, and polymeric silicic acids of the finest dispersion in the acidic tanning medium (pH of about 3–4.5).

The aluminosilicates neutralize themselves due to their own consumption of acid in the combination tanning process. Thus, the additional use of neutralizers becomes unnecessary. The stability of the tanning liquor is improved by the neutralization, and the penetration of the tanning agents through the skins is enhanced. Overall, the application of the tanning process becomes more flexible and more reliable.

In summary, a better leather quality, an improvement in the economy of the chrome tanning process, and a reduction in the environmental burden can be obtained by the use of the specific aluminosilicates in combination with the carboxylic acids described herein containing ester and/or urethane and/or amide groups according to the invention.

The carboxylic acids described herein may be used together with the aluminosilicates for the chrome tanning of leather. However, the addition of the mentioned carboxylic acids can be made advantageously to the strongly acid pickling liquor, that is, before the beginning of the actual tanning, since a high chrome content in the leather with especially uniform distribution is achieved in this manner.

Carboxylic acids useful according to the invention are those which have molecular weights of from about 200 to 30,000, preferably from about 310 to 10,000, possess at least two carboxyl groups per molecule, and are water-soluble or water-dispersible. The carboxylic acids can be prepared according to well-known methods. According to, for example, E. Muller, Houben-Weyl, "Methoden der Organischen Chemie", Vol. XIV/2, 1963, p. 16 ff, the products containing carboxyl groups can be obtained by the conversion of compounds containing hydroxyl and/or amino groups, at the molar ratio of $$\frac{-COOH}{-NH_2/OH} \geqq 1 .$$

The molecular weights of the resulting products generally exceed 200 and are less than 100,000. The products contain at least two COOH groups.

It is preferred however, that at least 90% of the carboxylic acid component has molecular weights in the range of from about 200–30,000, and especially preferably in the range of from about 310–10,000.

The formation of even higher molecular products is not impossible since these compounds never change completely into the theoretically calculable condensation products in a polycondensation procedure. The resulting compounds can be represented by, for example, the formula

X—COOH wherein X may represent one of the following

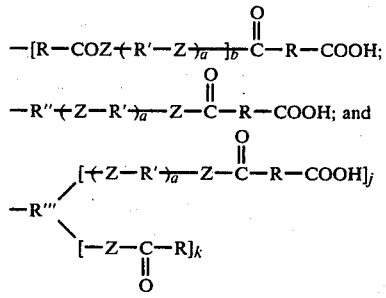

in which:

a and b each represent whole numbers form 0 to 100, preferably from 1 to 20;

j and k represent whole numbers from 0 to 6, whereby the sum of j plus k is 6 or less;

n represents a whole number from 0 to 20;

R represents $-(CH_2)_n-$ or an alkyl-substituted phenyl radical;

R′ represents $-(CH_2)_n-C(CH_3)-$ or $-(CH_2)_n-$;

R″ represents R or R′;

R‴ represents a radical of a polyvalent alcohol, e.g., sorbitol, glycerol, or trimethylolpropane; and Z represents

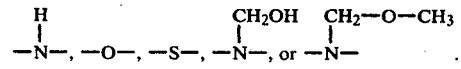

Suitable starting products are, if necessary, halogenated polycarboxylic acids, preferably dicarboxylic acids such as, e.g., adipic, glutaric, oxalic, malonic, maleic, terephthalic, phthalic, isophthalic, succinic, fumaric, aspartic, or glutamic acid.

The following substances can be used as hydroxyl compounds: alcohols such as alkanols, alkenols, alkynols, diols, polyols, amino alcohols, and ether alcohols. Preferred hydroxyl compounds are glycols such as ethylene glycol, diethylene glycol, triethylene glycol, polyethylene glycol, propylene glycol, dipropylene glycol, polypropylene glycol, butylene glycol, dibutylene glycol, and polybutylene glycol, aminoethanol, N-alkyldiethanolamine, stearyl alcohol, oleyl alcohol, trimethylolpropane, glycerol, and sugar alcohols such as, e.g., sorbitol.

Compounds containing amido or urethane groups are also suitable for the process according to the invention. Suitable are, e.g., compounds that are used for the preparation of polyesteramides, such as ethanediamine, ethanolamine, propanediamine, hexanediamine cyclohexanediamine, and dicyclohexylmethanediamine.

Suitable carboxylic acids with ester and/or urethane, and/or amide groups are obtained by, for example, the conversion of 2 moles each of adipic acid or terephthalic acid anhydride or dimethyl ester of malonic acid with 1 mole each of diethylene glycol or dipropylene glycol or 1,6-hexanediol or 1,12-octadecanediol or hexamethylenediamine, or of 5 moles adipic acid or terephthalic acid anhydride with 3 moles of trimethylolpropane, etc. The polyesters can also be converted further, e.g., with glutaric acid or ammonia. Additional examples of suitable compounds are found in German Published Application (DOS) No. 26 26 430, pp. 12–17, incorporated herein by reference.

Preferably, the useful carboxylic are prepared by reacting polycarboxylic acids with diols, diamines, polyols, polyamines, or amino alcohols.

The carboxylic acids with ester and/or urethane and/or amide groups can be used to special advantage, together with di- and/or tricarboxylic acids and/or their water-soluble, hydrolyzable partial esters, for chrome tanning. Examples of such compounds are aliphatic and/or aromatic carboxylic acids with from 2 to 8 carbon atoms in the chain, such as succinic acid, glutaric acid, adipic acid, maleic acid, fumaric acid, aspartic acid, glutamic acid, phthalic acid, terephthalic acid, or citric acid. These acids can also be used in the form of their hydrolyzable partial esters, e.g., with mono- or polyvalent alcohols with from about 1 to 6 carbon atoms, such as methanol, ethanol, n- and isopropanol, butanols, amyl alcohols, ethylene-, propylene-, and butylene glycols, glycerol, trimethylol propane, pentaerythritol, or sorbitol. Preferred esters are the monoesters of di- or trivalent acids since these hydrolyze relatively quickly in an acid medium, such as, for example, pickling or tanning liquor.

The aluminosilicates to be used according to the invention are amorphous, crystalline, synthetic and natural products which are ecologically acceptable, i.e., completely safe. Of particular importance are those products where Cat in the above-mentioned formula denotes an alkali metal ion, preferably a sodium ion, x is a number from 0.7 to 1.5, y is a number of from 0.8 to 6, preferably from 1.3 to 4, whose average particle size is from 0.1 to 25$\mu$, preferably from 1 to 12$\mu$, and which have a calcium binding power according to the Calcium Binding Power Test Method of from 20 to 200 mg CaO/gm of anhydrous active substance. Of equal importance are products, which are identical with the above-mentioned products as far as the meanings of Cat, x, y and the calcium binding power are concerned, and which merely differ by a larger average particle size of from more than 25$\mu$ to 5 mm.

Such alkali metal aluminosilicates can be produced synthetically in a simple manner, for example, by reaction of water-soluble silicates with water-soluble aluminates in the presence of water. For this purpose, aqueous solutions of the starting materials can be mixed with one another, or a component present in a solid state may be reacted with the other component present in the form of an aqueous solution.

The desired alkali metal aluminosilicates are also obtained by mixing the two components, present in a solid state, in the presence of water. Alkali metal aluminosilicates can also be produced from $Al(OH)_3$, $Al_2O_3$ or $SiO_2$ by reaction with alkali metal silicate solution or aluminate solutions, respectively. Finally, substances of this type are also formed from the melt, although, due to high melting temperatures required and the necessity of converting the melt into finely distributed products, this method appears to be less interesting from an economic viewpoint.

Many of these alkali metal aluminosilicates and their preparation are described in U.S. Pat. No. 4,071,377, as well as in U.S. patent application Ser. No. 458,306, filed Apr. 5, 1974, now abandoned in favor of its Continuation Ser. No. 800,308, filed May 25, 1977, now abandoned in favor of its Continuation-in-part Ser. No. 956,851, filed Nov. 2, 1978. The alkali metal aluminosilicates produced by precipitation, or converted to an aqueous suspension in a finely distributed state by other methods, may be converted from the amorphous state into the aged or crystalline state by heating to temperatures of from about 50° to 200° C. The amorphous or crystalline alkali metal alumino-silicate, present in an aqueous suspension, can be separated from the remaining aqueous solution by filtration and can be dried at temperatures of, for example, 50° to 800° C. The product contains a greater or smaller quantity of bound water according to the drying conditions. Anhydrous products are obtained by drying for 1 hour at 800° C. However, the hydrous products are preferred, particularly those obtained by drying at about 50° C. to 400° C., particularly at about 50° to 200° C. Suitable products can have, for example, water contents of from about 2 to 30%, usually from about 8 to 27%, relative to their total weight.

The precipitation conditions can contribute to the formation of the desired small particle sizes of from 1 to 12$\mu$, with the intermixed aluminate and silicate solutions—which may also be introduced simultaneously into the reaction vessel—being subjected to high shearing forces by, for example, intense agitation of the suspension. When crystalline alkali metal aluminosilicates are produced (these are preferably used in accordance with the invention), the formation of large, possibly interpenetrating crystals, is prevented by slow agitation of the crystallizing compound.

Nevertheless, undesired agglomeration of crystal particles may occur, particularly during drying, so that it may be advisable to remove these secondary particles in a suitable manner by, for example, air separation. Alkali metal aluminosilicates obtained in a coarser state and which have been ground to the desired grain size, can be used. By way of example, mills and/or air separators, or combinations thereof, are suitable for this purpose.

Preferred products are, for example, synthetically produced crystalline alkali metal aluminosilicates of the composition $$0.7\text{–}1.1M_2O.Al_2O_3.1.3\text{–}3.3SiO_2,$$

in which M represents an alkali metal cation, preferably a sodium cation. It is advantageous if the alkali metal aliminosilicate crystallites have rounded corners and edges.

It it is desired to produce the alkali metal aluminosilicates with rounded corners and edges, it is advantageous to start with a preparation whose molar composition lies preferably in the range $$2.5\text{–}6.0M_2O.Al_2O_3.0.5\text{–}5.0SiO_2.60\text{–}200H_2O$$

wherein M has the meaning given above and, in particular, represents the sodium ion. This preparation is crystallized in a conventional manner. Advantageously, this is effected by heating the preparation for at least ½ hour at from 70° to 120° C., preferably at from 80° to 95° C., under agitation. The crystalline product is isolated in a simple manner by separating the liquid phase. If required, it is advisable to re-wash the products with water and to dry them before further processing. Even when working with a preparation whose composition differs only slightly from that stated above, products having rounded corners and edges are still obtained, particularly when the difference only relates to one of the four concentration parameters given above.

Furthermore, fine-particulate water-insoluble alkali metal aluminosilicates may also be used in the method of the invention which have been precipitated and aged or crystallized in the presence of water-soluble inorganic or organic dispersing agents. Products of this type are described in U.S. patent applications Ser. No. 503,467, filed Sept. 5, 1974, now abandoned; Ser. No. 763,667, filed Jan. 28, 1977, now abandoned; and Ser. No. 811,964, filed June 30, 1977. They are obtainable in a technically simple manner. Suitable water-soluble organic dispersing agents are tensides, i.e., surface-active compounds, non-surface-active-like aromatic sulfonic acids, and compounds having a complex-forming capacity for calcium. The said dispersing agents may be introduced into the reaction mixture in an optional manner before or during precipitation, and, for example, they may be introduced in the form of a solution or they may be dissolved in the aluminate solution and/or silicate solution. Particularly satisfactory effects are obtained when the dispersing agent is dissolved in the silicate solution. The quantity of dispersing agent should be at least 0.5 percent by weight, preferably from about 0.1 to 5 percent by weight, based on the total amount of precipitate obtained. The product of precipitation is heated to temperatures of from 50° to 200° C. for from ½ to 24 hours for the purpose of aging or crystallization. By way of example, sodium lauryl ether sulfate, sodium polyacrylate, hydroxyethane diphosphonate and others, may be mentioned from the large number of dispersing agents which may be used.

Compounds of the general formula $$0.7\text{–}1.1Na_2O.Al_2O_3.>2.4\text{–}3.3SiO_2$$

constitute a special variant, with respect to their crystal structure, of the alkali metal aluminosilicates to be used in accordance with the invention.

Compounds of the formula $$0.7\text{–}1.1Na_2O.Al_2O_3>3.3\text{–}5.3SiO_2$$

constitute a further variant of the water-insoluble aluminosilicates to be used in accordance with the invention. The production of such products is based on a preparation whose molar composition lies preferably in the range $$2.5\text{–}4.5Na_2O.Al_2O_3.3.5\text{–}6.5SiO_2.50\text{–}110H_2O$$

This preparation is crystallized in a conventional manner. Advantageously, this is effected by heating the preparation for at least ½ hour to from 100° to 200° C., preferably to from 130° to 160° C., under vigorous agitation. The crystalline product is isolated in a simple manner by separation of the liquid phase. If required, it is advisable to wash the products with water and to dry them at temperatures of from 20° to 200° C., before further processing. The dried products thus obtained still contain bound water. When the products are produced in the manner described, very fine crystallites which come together to form spherical particles, possibly to form hollow balls having a diameter of approximately 1 to 4μ, are obtained.

Furthermore, alkali metal aluminosilicates suitable for use in accordance with the invention are those which can be produced from calcinated (destructured) kaolin by hydrothermal treatment with aqueous alkali metal hydroxide. The formula $$0.7\text{–}1.1M_2O.Al_2O_3.1.3\text{–}2.4SiO_2.0.5\text{–}5.0H_2O$$

corresponds to the products, M signifying an alkali metal cation, particularly a sodium cation. The production of the alkali metal aluminosilicates from calcinated kaolin leads, without any special technical expense, directly to a very fine-particulate product. The kaolin, previously calcinated at from 500° to 800° C., is hydrothermally treated with aqueous alkali metal hydroxide at from 50° to 100° C. The crystallization reaction thereby taking place is generally concluded after from 0.5 to 3 hours.

Commercially available, elutriated kaolins predominantly comprise the clay mineral kaolinite of the approximate composition $Al_2O_3.2SiO_2.2H_2O$ and which has a layer structure. To obtain therefrom by hydrothermal treatment with alkali hydroxide, the alkali metal aluminosilicates to be used in accordance with the invention, it is first necessary to destructure the kaolin, this being effected to best advantage by heating the kaolin to temperatures of from 500° to 800° C. for from two to four hours. The X-ray amorphous anhydrous metakaolin is thereby produced from the kaolin. In addition to destructuring the kaolin by calcination, the kaolin can also be destructured by mechanical treatment (grinding) or by acid treatment.

The kaolins usable as starting materials are light-colored powders of great purity; of course, their iron content of from approximately 2,000 to 10,000 ppm Fe is substantially higher than the values of from 20 to 100 ppm Fe in the alkali metal aluminosilicates produced by precipitation from alkali metal silicate and alkali metal aluminate solutions. This higher iron content in the alkali metal aluminosilicates produced from kaolin is not disadvantageous, since the iron is firmly bedded in the form of iron oxide in the alkali metal aluminosilicate lattice and is not dissolved out. A sodium aluminosilicate having a cubic, faujasite-like structure is produced during the hydrothermal action of sodium hydroxide on destructured kaolin. Production of such alkali metal aluminosilicates from destructured kaolin with a low-iron content is described in U.S. Patent Application Ser. No. 819,666, filed July 28, 1977, now U.S. Pat. No. 4,089,929 issued May 19, 1978.

Alkali metal aluminosilicates, usable in accordance with the invention, may also be produced from calcinated (destructured) kaolin by hydrothermal treatment with aqueous alkali metal hydroxide with the addition of silicon dioxide or a compound producing silicon dioxide. The mixture of alkali metal aluminosilicates of differing crystal structure, generally obtained thereby, comprises very fine-particulate crystal particles having a diameter of less than 20μ, and up to 100% of which usually comprises particles having a diameter of less than 10μ. In practice, this conversion of the destructured kaolin is effected preferably with aqueous sodium hydroxide and water glass. A sodium aluminosilicate J is thereby produced which is known by several names in the literature, for example, Molecular Sieve 13 X or zeolite NaX (see, O. Brubner, P. Jiru and M. Ralek, "Molecular Sieves", Berlin 1968, pp. 32, 85–89), when the preparation is preferably not agitated during the hydrothermal treatment at all events, when only low shearing energies are used, and the temperature preferably remains at 10° to 20° C. below the boiling temperature (approximately 103° C.). The sodium aluminosilicate J has a cubic crystal structure similar to that of natural faujasite. The conversion reaction may be influenced particularly by agitating the preparation, at elevated temperature (boiling heat at normal pressure or in an autoclave) and greater quantities of silicate, that is, by a molar preparation ratio $SiO_2$:$Na_2O$ at least 1, particularly 1.0 to 1.45, such that sodium aluminosilicate F is produced in addition to, or instead of, sodium aluminosilicate J. Sodium aluminosilicate F is designated "zeolite P" or "type B" in the literature (see, D. W. Breck, "Zeolite Molecular Sieves", New York, 1974, page 72). Sodium aluminosilicate F has a structure similar to the natural zeolites gismondine and garronite and is present in the form of crystallites having an externally spherical appearance. In general, the conditions for producing the sodium aluminosilicate F and for producing mixtures of J and F are less critical than those for a pure crystal type A.

The above-described types of different alkali metal aluminosilicates can also be produced without difficulties in a coarser form with particle sizes of from more than 25μ to mm, in addition to the finely-divided form with particles sizes of from 0.1 to 25μ. This can be done either by omitting the measures that prevent large crystal growth or agglomeration, or by transforming the finely-divided product subsequently in known manner into the granulated form. The desired particle size can be adjusted subsequently, if desired, by grinding and air sifting.

For use in the manufacture of leather in combination with the polycarboxylic acids described above, aluminosilicates also can be used where Cat in the above formula denotes an alkali metal ion and/or a bivalent and/or trivalent cation, where Cat consists at least of 20 mol % of alkali metal ions, preferably sodium ions, x denotes a number of from 0.7 to 1.5, n a number of from 1 to 3, y a number of from 0.8 to 6, preferably from 1.3 to 4, with a particle size of from 0.1μ to 5 mm, and a calcium-binding power of from 20 to 200 mg CaO/gm of anhydrous active substance when measured according to the Calcium Binding Power Test Method.

For the production of aluminosilicates containing bivalent or trivalent cations, the above-mentioned reactions for the preparation of the alkali metal aluminosilicates can be carried out in some cases with aluminates or silicates which already contain the corresponding cations in salt form. In general, corresponding aluminosilicates are obtained in known manner by ion exchange from alkali metal aluminosilicates with polyvalent cations, e.g., calcium, magnesium, zinc or aluminum ions.

Examples of aluminosilicates, where the alkali metal cations are partly replaced by polyvalent cations, particularly calcium, magnesium, or zinc ions, are represented by the following formulas, bound water not shown:

$0.8CaO.0.2Na_2O.Al_2O_3.2SiO_2$, $0.4CaO.0.5Na_2O.Al_2O_3.SiO_2$, $0.18MgO.0.77Na_2O.Al_2O_3.1.9SiO_2$, $0.16MgO.0.8Na_2O.Al_2O_3.2.05SiO_2$, $0.11ZnO.0.92Na_2O.Al_2O_3.2SiO_2$.

The products contain about from 8 to 27% by weight of bound water. They can be used in their crystalline, as well as in their amorphous forms.

Other aluminosilicates suitable for use according to the invention are those where Cat in the above formula denotes an alkali metal ion and/or a bivalent and/or trivalent cation, x a number from 0.5 to 1.8, y a number from 0.8 to 6, preferably from 1.3 to 4, with a particle size of from 0.1μ to 5 mm, and a calcium binding power of from 0 to <20 mg CaO/gm of anhydrous active substance.

Among the aluminosilicates of this group are amorphous, crystalline, synthetic, and natural products. They can be synthetized in a simple manner, for example, by reacting water-soluble silicates with water-soluble aluminates in the presence of water, as it was described principally in the preceding production methods. As examples of such products we mention the following aluminosilicates:

| | |
|---|---|
| $1.05\ Na_2O\ .\ Al_2O_3\ .\ 3.8\ SiO_2$ | Ca binding power 0 mg CaO/gm |
| $1.0\ Na_2O\ .\ Al_2O_3\ .\ 2.1\ SiO_2$ | Ca binding power 16 mg CaO/gm |
| $0.05\ Na_2O\ .\ 0.94\ CaO\ .\ Al_2O_3\ .\ 1.92\ SiO_2$ | Ca binding power <15 mg CaO/gm |
| $0.09\ Na_2O\ .\ 0.82\ MgO\ .\ Al_2O_3\ .\ 2.38\ SiO_2$ | Ca binding power <15 mg CaO/gm |

Also suitable for use according to the invention are aluminosilicates where Cat in the above formula denotes an alkali metal ion and/or a bivalent and/or trivalent cation, x a number of from 0.5 to 1.8, y a number of from >6 to 50, preferably from >6 to 20, with a particle size of from 0.1μ to 5 mm, and a calcium-binding power of from 0 to 200 mg CaO/gm anhydrous substance according to the Calcium Binding Power Test Method.

These aluminosilicates can be amorphous or crystalline and be of synthetic or natural origin. They can be synthetized in a simple manner, such as, by reacting water-soluble silicates with water-soluble aluminates in the presence of water. To this end, aqueous solutions of the starting material can be mixed with each other, or one component, which is present in solid form, can be reacted with the other component, which is present as an aqueous solution. The introduction of polyvalent cations can be effected according to methods known from the literature by exchanging monovalent cations, for example, sodium ions, with bivalent and trivalent cations, such as calcium, magnesium, zinc or aluminum ions. The natural aluminosilicates can also contain other cations in a fluctuating, mostly small amount in addition to the above-mentioned cations. Among these are alkali metals such as lithium and potassium; thallium; manganese; cobalt; and nickel ions. Synthetic aluminosilicates can also contain, as cations, quaternary nitrogen compounds, such as ammonium ions, in varying amounts. The extent to which the aluminosilicates are laden with the above-mentioned cations depends largely on the size of the coefficient of selectivity. Preferably, however, aluminosilicates of the above-indicated general composition are used, where Cat in the above-mentioned formula is an alkali metal ion, preferably a sodium ion. Examples of these products are represented by the following formulas:

$1.3Na_2O.Al_2O_3.13.4SiO_2$ $0.6Na_2O.Al_2O_3.8.3SiO_2$ $1.1Na_2O.Al_2O_3.14.8SiO_2$ $1.5Na_2O.Al_2O_3.12.2SiO_2$ $1.5Na_2O.Al_2O_3.11.8SiO_2$

An essential criterion for the usability of all the above mentioned aluminosilicates according to the invention is their least partial acid solubility in the pH range of from 2.5 to 5, preferably from 3.5 to 4.5. The products that meet this requirement are at least partly dissolved by a solution of 2.5 ml concentrated formic acid in 100 ml water. This acid solubility test is carried out as follows:

A suspension of 2 gm of aluminosilicates (related to the anhydrous active substance) in 100 ml distilled water is mixed slowly under stirring in the course of from 8 to 30 minutes at a temperature of 22° C. with 2 ml of concentrated formic acid. For aluminosilicates that can be used according to the invention, the pH value, of the suspension after the total addition of the 2 mg formic acid must be above 2.5, between 2.5 and 5.5, and preferably between 3.5 and 4.5. If these pH values are attained in the titration, we have an aluminosilicate which is suitable for use according to the invention in view of its acid binding power. Products where a pH value outside this range is found according to this method, have either a too low acid binding power or a too high alkalinity, and are not usable in the sense according to the invention. For strict neutralizing purposes, which are not the subject of the present invention, aluminosilicates with a higher alkalinity can also be used.

The calcium binding power, i.e., complexing capacity, can be determined according to the Calcium Binding Power test, which as as follows:

One liter of an aqueous solution containing 0.594 g $CaCl_2$ (300 mg CaO/l=30° dH) (German hardness degrees), and standarized with diluted NaOH to a pH value of 10, is mixed with 1 gm of the aluminosilicate, calculated as an anhydrous product. Then the suspension is stirred vigorously for 15 minutes at a temperature of 22° C. After filtering off the aluminosilicate, the residual hardness x of the filtrate is determined, from which the calcium binding power is calculated in mg CaO/gm of aluminosilicate according to the formula: $(30-x)=10$.

The tanning of fur skins and and leather is carried out in known manner. Also, pickling and tanning may be combined with each other in known manner. This may be followed by an application of oil, dubbin, to the leather. In chrome tanning, from about 1 to 50 gm/l, preferably from about 15 to 30 gm/l, of aluminosilicate, based on the anhydrous product, are used in the tanning liquor. The carboxylic acids containing ester and/or urethane and/or amide groups are added to the tanning liquor in an amount of from 1 to 20 gm/l. Preferably, reaction products of adipic acid and dipropylene glycol (COOH: OH ratio of 2:1) or reaction products of adipic acid and trimethylolpropane (COOH: OH ratio of 5:3) are used. In a jointly concurrent pickling and chrome tanning, the acid can be added to the pickling liquor. The amount added is then from about 1 to 20 gm/l liquor, as well. In addition to this, the usual active and adjuvant substances, e.g., anionic, cationic or nonionic surface-active compounds or tensides, chrome salts, etc., are used in the tanning and pickling liquors.

In the process according to the invention, the concentration of the chrome salts in the tanning liquor can be reduced by 25 to 50% as compared with regular tanning methods.

The following preparations and examples are illustrative of the practice of the invention without being limitative in any manner.

PREPARATIONS

I. The production of suitable alkali metal aluminosilicates

The silicate solution was added to the aluminate solution under vigorous agitation in a vessel having a capacity of 15 liters. Agitation was effected at 3000 r.p.m. by means of an agitator having a dispersing disc. The two solutions were at room temperature. An X-ray amorphous sodium aluminosilicate was formed as a primary product of precipitation with an exothermic reaction. After agitating for 10 minutes, the suspension of the precipitation product was transferred to a crystallizer and, for the purpose of crystallization, remained in the crystallizer for 6 hours at 90° C. under agitation (250 r.p.m.). The mother liquor was drawn off from the crystal sludge and the filtration residue was washed with deionized water until the washing water flowing off had a pH value of approximately 10. Therefore the washed filtration residue was dried as specified. Instead of the dried sodium aluminosilicate, the suspension of the crystallization product or the crystal sludge was also used to produce the auxiliary soaping agents. The water contents were determined by heating the predried products to 800° C. for 1 hour. The sodium aluminosilicates, washed or neutralized to the pH value of approximately 10, and then dried, were subsequently ground in a ball mill. The grain size distribution was determined by means of a sedimentation balance.

Conditions for producing sodium aluminosilicate A

| | |
|---|---|
| Precipitation: | 2.985 kg of aluminate solution of the composition: 17.7% $Na_2O$, 15.8% $Al_2O_3$, 66.6% $H_2O$<br>0.15 kg of caustic soda<br>9.420 kg of water<br>2.445 kg of a 25.8% sodium silicate solution of the composition 1 $Na_2O$ . 6.0 $SiO_2$, freshly prepared from a commercial sodium silicate and silicic acid that is readily soluble in alkali |
| Crystallization: | 6 hours at 90° C. |
| Drying: | 24 hours at 100° C. |
| Composition: | 0.9 $Na_2O$ . 1 $Al_2O_3$ . 2.04 $SiO_2$ 4.3 $H_2O$ (= 21.6% $H_2O$) |
| Degree of crystallization: | Fully crystalline. |
| Calcium binding power: | 170 mg CaO/gm active substance. |

The particle size distribution, determined by sedimentation analysis, resulted in a mixture range of the particle size distribution curve at 3 to 6μ.

The sodium aluminosilicate A exhibits the following interference lines in the X-ray diffraction graph:

d values, photographed with Cu-$K_\alpha$ radiation in Å

I

–

12.4

–
8.6
7.0
–
4.1 (+)
–
3.68 (+)
3.38 (+)
3.26 (+)
2.96 (+)
–
–
2.73 (+)
–
2.60 (+)

It is quite possible that all these interference lines will not appear in the X-ray diffraction graph particularly when the aluminosilicates are not fully crystallized. Thus, the most important d values for characterizing, these types have been characterized by a "(+)".

Conditions for producing sodium aluminosilicate B

| | |
|---|---|
| Precipitation: | 7.63 kg of an aluminate solution of the composition 13.2% $Na_2O$; 8.0% $Al_2O_3$; 78.8% $H_2O$; 2.37 kg of a sodium silicate solution of the composition 8.0% $Na_2O$; 26.9% $SiO_2$; 65.1% $H_2O$; |
| Preparation ratio in mol: | 3.24 $Na_2O$; 1.0 $Al_2O_3$; 1.78 $SiO_2$; 70.3 $H_2O$; |
| Crystallization: | 6 hours at 90° C.; |
| Drying: | 24 hours at 100° C.; |
| Composition of the dried product | 0.99 $Na_2O$ . 1.00 $Al_2O_3$ . 1.83 $SiO_2$ 4.0 $H_2O$; (= 20.9% $H_2O$) |
| Crystalline form: | Cubic with greatly rounded corners and edges; |
| Average particle diameter: | 5.4μ |
| Calcium binding power: | 172 mg CaO/gm active substance. |

Conditions for producing sodium aluminosilicate C

| | |
|---|---|
| Precipitation: | 12.15 kg of an aluminate solution of the composition 14.5% $Na_2O$; 5.4% $Al_2O_3$; 80.1% $H_2O$; 2.87 kg of a sodium silicate solution of the composition 8.0% $Na_2O$; 26.9% $SiO_2$; 65.1% $H_2O$; |
| Preparation ratio in mol: | 5.0 $Na_2O$; 1.0 $Al_2O_3$; 2.0 $SiO_2$; 100 $H_2O$; |
| Crystallization: | 1 hour at 90° C.; |
| Drying: | Hot atomization of a suspension of the washed product (pH 10) at 295° C.; Content of solid substance in the suspension 46%; |
| Composition of the dried product: | 0.96 $Na_2O$ . 1 $Al_2O_3$ . 1.96 $SiO_2$ 4 $H_2O$; |
| Crystalline form: | Cubic with greatly rounded corners and edges; Water content 20.5%; |
| Average particle diameter: | 5.4μ |
| Calcium binding power: | 172 mg CaO/gm active substance. |

Conditions for producing potassium aluminosilicate D

The sodium aluminosilicate C was produced in the first instance. After the mother liquor had been drawn off, and the crystalline mass had been washed to the pH value 10 with demineralized water, the filtration residue was suspended in 6.1 l of a 25% KCl solution. The suspension was heated for a short time to 80° to 90° C., and was then cooled, filtrated off again and washed.

| | |
|---|---|
| Drying: | 24 hours at 100° C.; |
| Composition of the dried product: | 0.35 $Na_2O$ . 0.66 $K_2O$ . 1.0 $Al_2O_3$ 1.96 $SiO_2$ . 4.3 $H_2O$; (water content 20.3%) |

Conditions for producing sodium aluminosilicate E

| | |
|---|---|
| Precipitation: | 0.76 kg of aluminate solution of the composition: 36.0% $Na_2O$, 59.0% $Al_2O_3$, 5.0% water 0.94 kg of caustic soda; 9.94 kg of water; 3.94 kg of a commercially available sodium silicate solution of the composition: 8.0% $Na_2O$, 26.9% $SiO_2$, 65.1% $H_2O$; |
| Crystallization: | 12 hours at 90° C.; |
| Drying: | 12 hours at 100° C.; |
| Composition: | 0.9 $Na_2O$ . 1 $Al_2O_3$ . 3.1 $SiO_2$ . 5 $H_2O$; |
| Degree of crystallization: | Fully crystalline. |
| The maximum range of the particle size distribution curve at 3 to 6μ. | |
| Calcium binding power: | 110 mg CaO/gm active substance. |

The aluminosilicate E exhibited the following interference lines in the X-ray diffraction graph:
d-values, photographed with Cu-$K_\alpha$ radiation in Å
14.4
–
8.8
–
–
4.4
–
3.8
–
–
–
–
2.88
2.79
–
2.66
–

Conditions for producing sodium aluminosilicate F

| | |
|---|---|
| Precipitation: | 10.0 kg of an aluminate solution of the composition: 0.84 kg $NaAlO_2$ + 0.17 kg NaOH + 1.83 kg $H_2O$; 7.16 kg of a sodium silicate solution of the composition 8.0% $Na_2O$, 26.9% $SiO_2$, 65.1% $H_2O$; |
| Crystallization: | 4 hours at 150° C.; |
| Drying: | Hot atomization of a 30% suspension of the washed product (pH 10); |
| Composition of the dried product: | 0.98 $Na_2O$ . 1 $Al_2O_3$ . 4.12 $SiO_2$. 4.9 $H_2O$; |
| The particles were of spherical shape; the average diameter of the balls was approximately 3 to 6μ. | |
| Calcium binding power: | 132 mg CaO/gm active substance at 50° C. |

Conditions for producing sodium aluminosilicate G

| | |
|---|---|
| Precipitation: | 7.31 kg aluminate (14.8% $Na_2O$, 9.2% $Al_2O_3$, 76.0% $H_2O$) 2.69 kg silicate (8.0% $Na_2O$, 26.9% $SiO_2$, 65.1% $H_2O$); |
| Preparation ratio in mol: | 3.17 $Na_2O$, 1.0 $Al_2O_3$, 1.82 $SiO_2$, 62.5 $H_2O$; |
| Crystallization: | 6 hours at 90° C.; |
| Composition of the dried product: | 1.11 $Na_2O$ . 1 $Al_2O_3$ . 1.89 $SiO_2$, 3.1 $H_2O$ (= 16.4% $H_2O$); |
| Crystalline structure: | Mixed structural type in the ratio 1:1; |
| Crystalline form: | Rounded crystallites; |
| Average particle diameter: | 5.6μ. |
| Calcium binding power: | 105 mg CaO/gm active substance at 50° C. |

Conditions for producing sodium aluminosilicate H produced from kaolin

1. Destructuring Kaolin

In order to activate the natural kaolin, samples of 1 kg were heated to 700° C. in a Schammote crucible for 3 hours. The crystalline kaolin $Al_2O_3.SiO_2.2H_2O$ was thereby converted to the amorphous metakaolin $Al_2O_3.2SiO_2$.

2. Hydrothermal treatment of metakaolin

The alkali solution was placed in an agitating vessel and the calcined kaolin was added under agitation at temperatures between 20° and 100° C. The suspension was brought to the crystallization temperature of 70° to 100° C. under agitation, and was maintained at this temperature until the crystallization operation had terminated. The mother liquor was subsequently drawn off and the residue was washed with water until the washing water draining off had a pH value of from 9 to 11. The filter cake was dried and was subsequently crushed to a fine powder or was ground to remove the agglomerates produced during drying. This grinding process was omitted when the filtration residue was further processed in a wet state or when the drying operation was performed by means of a spray dryer or a flow dryer. Alternatively, the hydrothermal treatment of the calcined kaolin can be performed in a continuous operation.

| | |
|---|---|
| Preparation: | 1.65 kg of calcined kaolin 13.35 kg of 10% NaOH, mixed at room temperature; |
| Crystallization: | 2 hours at 100° C.; |
| Drying: | 2 hours at 160° C. in a vacuum drying cabinet; |
| Composition: | 0.88 $Na_2O$ . 1 $Al_2O_3$ . 2.14 $SiO_2$ . 3.5 $H_2O$ (= 18.1% $H_2O$); |
| Crystalline structure: | Mixed structural type like Na aluminosilicate G, although in the ratio 8:2. |
| Average particle diameter: | 7.0μ. |
| Calcium binding power: | 126 mg CaO/gm active substance. |

Conditions for producing sodium aluminosilicate J produced from kaolin

The destructuring of the kaolin and the hydrothermal treatment were effected in the same manner as in the case of H.

| | |
|---|---|
| Preparation: | 2.6 kg of calcined kaolin, |

-continued

| | |
|---|---|
| | 7.5 kg of 50% NaOH, 7.5 kg of water glass, 51.5 kg of deionized water, mixed at room temperature; |
| Crystallization: | 24 hours at 100° C., without agitation; |
| Drying: | 2 hours at 160° C. in a vacuum drying cabinet; |
| Composition: | 0.93 $Na_2O$ . 1.0 $Al_2O_3$ . 3.60 $SiO_2$ . 6.8 $H_2O$ (= 24.6% $H_2O$); |
| Crystalline structure: | Sodium aluminosilicate J in accordance with above definition, cubic crystallites; |
| Average particle diameter: | 8.0 μ |
| Calcium binding power: | 105 mg CaO/gm active substance. |

Preparation of sodium aluminosilicate K in granulated form

For the preparation of the granulated alkali metal aluminosilicates utilizable according to the invention, dried, finely-divided crystalline aluminosilicates which still contained 15 to 25% bound water were employed as starting materials.

Fifty kg of a powdered, crystalline, dried aluminosilicate of the composition 0.9 mole $Na_2O$ 0.1 mole $Al_2O_3$. 2.04 moles $SiO_2$.4.3 moles $H_2O$ (aluminosilicate A), were suspended in a 300 l agitator vessel with 180 l water, and standardized to a pH value of 6 with 25% hydrochloric acid. This suspension was stirred moderately for 40 minutes. Then the aluminosilicate was separated on a vacuum filter, and the filter cake was washed out three times with 20 l water each. The aluminosilicate was dried in a drying cabinet for 10 hours at 105° C.

This dried aluminosilicate was mixed with 10kg of benonite and 20.1 kg of water, which had been standardized to a pH value of 6 with 25% hydrochloric acid, and the mixture was homogenized for 20 minutes in a 100 kg "Loedige" mixer (blade mixer by Loedige). Under continued mixing and gradual addition of 1.35 kg of additional water, which had likewise been standardized to a pH of 6 with 25% hydrochloric acid, within another 8 minutes the desired granulated product was obtained.

The granulated material was dried in a drying cabinet for 60 minutes at 150° C. and solidified by subsequent heating (15 minutes at 780° C.).

In order to determine the exchange power, 1 gm of the granulated material was boiled in 500 ml tap water of 16° dH for 5 minutes. After cooling and filtering, the residual hardness of the resultant filtrate was determined as discussed above. The calcium binding power of the product was 120 mg CaO/gm active substance. The particle size was 0.08 to 2 mm.

When an Eirich turbo mixer (pan/turbo mixer by Eirich) was used, the required homogenization and granulation periods were shorter. When the above-described procedure was used for the preparation of sodium aluminosilicate A in granulated form, the homogenization and the granulation were already completed after 5 minutes (instead of 28 minutes in the blade mixer). After drying for 15 minutes at 100° C. and calcining for 5 minutes at 800° C. in an air muffle furnace, a granulated product was obtained with a good exchange power, good hot water resistance, and good grain stability.

The calcium binding power of the product was 110 mg CaO/gm of active substance. The particle size was 0.08 to 2 mm.

In a corresponding manner, other granulated products of alkali metal aluminosilicates can also be prepared with particle sizes of more than 25μ to 5 mm, if alkali metal aluminum silicates of the types B to J are treated according to the above-described procedure.

Other granulating methods, like those described in U.S. Pat. No. 3,356,450 and German Pat. No. 1,203,238 are also suitable for the preparation of the alkali metal aluminosilicates to be used according to the invention.

Preparation of aluminosilicate L

A product of the composition $0.98Na_2O.Al_2O_3.1.96SiO_2.4.2H_2O$, prepared according to the instructions for alkali metal aluminosilicate C, was suspended in a solution containing calcium chloride. Under exothermic reaction, sodium was exchanged against calcium. After a reaction time of 15 minutes, the product was filtered off and washed, then spray-dried at an atomization temperature of 198° to 250° C. by hot atomization of a 40% suspension. The product obtained had the following characteristics:

| | |
|---|---|
| Composition: | $0.28\ Na_2O\ .\ 0.7\ CaO\ .\ Al_2O_3\ .\ 1.96\ SiO_2\ .\ 4\ H_2O$ |
| Calcium binding power: | >20 mg CaO/gm of active substance |
| Particle size: | Mean particle diameter: 5.8 μ |
| Crystal form: | A-type, crystalline |

Preparation of aluminosilicate M

An aluminosilicate of the composition $0.89Na_2O.Al_2O_3.2.65SiO_2.6H_2O$ was suspended in a solution containing magnesium chloride. After a reaction time of 30 minutes at 80° C. to 90° C., the product was filtered off and washed. The drying was effected as shelf-drying for 16 hours at 100° C. The product obtained had the following characteristics:

| | |
|---|---|
| Composition: | $0.42\ Na_2O\ .\ 0.47\ MgO\ .\ Al_2O_3\ .\ 2.61\ SiO_2\ .\ 5.6\ H_2O$ |
| Calcium binding power: | >25 mg CaO/gm of active substance |
| Particle size: | Average particle diameter: 10.5 μ |

Preparation of aluminosilicate N

An X-ray amorphous aluminosilicate of the composition $1.03Na_2O.Al_2O_3.2.14SiO_2.5.8H_2O$ was treated in the manner described under aluninosilicate M in a solution containing zinc sulfate; subsequently it was washed and dried under mild conditions. The product obtained had the following characteristics:

| | |
|---|---|
| Composition: | $0.92\ Na_2O\ .\ 0.11\ ZnO\ .\ Al_2O_3\ .\ 1.98\ SiO_2\ .\ 6\ H_2O$ |
| Calcium binding power: | 76 mg CaO/gm of active substance |
| Particle size: | Average particle diameter: 36 μ |

Preparation of aluminosilicate O

Fifty kg of aluminosilicate L were suspended in a 300 l agitator vessel with 180 l water and standardized with 25% hydrochloric acid to a pH of 6. The suspension was stirred moderately vigorously for 40 minutes. Then the aluminosilicate was filtered off, washed repeatedly with water and dried for 10 hours at 105° C. The dried aluminosilicate was mixed with 10 kg of bentonite, and 20 l of water, which had been standardized with 25% hydrochloric acid to a pH of 6, and homogenized in a 100 kg blade mixer for 20 minutes. A granulated product was obtained within another 8 minutes under stirring, by adding gradually 13.5 l water, which had been standardized to a pH of 6. The granulated product was dried for 60 minutes at 150° C. and solidified by heating for 15 minutes to 780° C. The particle size distribution of the aluminosilicate O thus obtained was from 1 to 2 mm.

Preparation of aluminosilicate P

In a vessel of 1.5 l capacity, were charged 80 gm of a 15% solution of hexadecyl-trimethyl-ammonium chloride and 140 gm of a 35% sodium silicate ($Na_2O:SiO_2=1:3.4$), dissolved in 550 ml water. Under vigorous mixing, 46 gm of sodium aluminate (38% $Na_2O$, 52% $Al_2O_3$), dissolved in 150 ml water, and immediately thereafter 43.9 gm of $MgSO_4.7\ H_2O$, dissolved in 100 gm of water, were added. After stirring for 3 hours, the product thus formed was filtered off, washed with water, and the filter residue was dried for 35 hours at 100 torr and 80° C. The product obtained had the following characteristics:

| | |
|---|---|
| Composition: | $0.6\ Na_2O\ .\ 0.24\ MgO\ .\ 0.83\ Al_2O_3\ .\ 2.0\ SiO_2\ .\ 4.8\ H_2O$ and 7% hexadecyl-trimethyl-ammonium chloride |
| Calcium binding power: | 84 mg CaO/gm of active substance |
| Particle size: | Average particle diameter: 16 μ (after grinding) |

Preparation of Aluminosilicate Q

In a vessel of 1.5 l capacity were charged 142.9 gm of a 35% sodium silicate ($Na_2O:SiO_2=1:3.4$), dissolved in 507.4 gm of water, and mixed under stirring with 48.3 gm of sodium aluminate (38% $Na_2O$, 52% $Al_2O_3$), dissolved in 150 gm of water. Subsequently 42.4 gm of $Al_2(SO_4)_3.\ 18\ H_2O$, dissolved in 100 gm of water, were added and then, after stirring for 10 minutes, 8 gm of a 50% solution of sodium dodecyl-benzene sulfonate were added. After stirring for another 160 minutes, the suspension was treated as described under aluminosilicate P. The product obtained of the composition $1.0Na_2O.Al_2O_3.2.1SiO_2.4.1H_2O$ with 2.1% sodium dodecyl-benzene sulfonate, with a calcium binding power of 128 mg CaO/gm of active substance and an average particle diameter of 19μ, was treated for 30 minutes at 60° C. with a diluted aluminum sulfate solution. After filtration, washing and subsequent drying at 80 torr and 100° C. for 6 hours, the solid substance was ground. The product obtained had the following characteristics:

| | |
|---|---|
| Composition: | $0.59\ Na_2O\ .\ 1.1\ Al_2O_3\ .\ 1.98\ SiO_2\ .\ 4.9\ H_2O$ |
| Calcium binding power: | 56 mg CaO/gm of active substance |
| Particle size: | Average particle diameter: 50 μ |

The aluminosilicates, where Ca in the above formula denotes an alkali metal ion and/or a bivalent and/or trivalent cation, x a number from 0.5 to 1.8, where the particle size is 0.1μ to 5 mm, y denotes, on the one hand, a number from 0.8 to 6 with a calcium binding power of 0 to <20 mg and, on the other hand, a number from >6 to 50 with a calcium binding power of 0 to 200 mg CaO/gm of anhydrous active substance, can be prepared principally in the same manner as indicated in the above-described production methods. Beyond that, a part of the products are naturally occurring aluminosilicates.

Preparation of aluminosilicate R

In a vessel of 15 l capacity, an aluminate solution of the composition 0.84 kg $NaAlO_2$, 0.17 kg NaOH, 1.83 kg $H_2O$, was mixed with 7.16 kg of a sodium silicate solution (8.0% Na20, 26.9% $SiO_2$, 65.1% $H_2O$). The stirring was done with a beam stirrer at 300 rpm. Both solutions were charged at room temperature. An X-ray amorphous sodium aluminosilicate was formed as a primary precipitation product. After stirring for 10 minutes, the suspension of the precipitation product was transferred to a crystallization vessel in which it remained for 8 hours under vigorous stirring (500 rpm) at 150° C. to effect the crystallization. After draining the liquor from the crystal sludge and washing with water until the outflowing water had a pH of about 11, the about 36% suspension of the washed product was dried by hot atomization. The product obtained, a synthetic crystalline zeolite (Analcite), had the following characteristics:

| | |
|---|---|
| Composition: | 1.05 $Na_2O$ . $Al_2O_3$ . 3.8 $SiO_2$ |
| Calcium binding power: | O mg CaO/gm of active substance |
| Average particle diameter: | 12.3 $\mu$ |

Preparation of aluminosilicate S

The preparation was similar to that indicated for aluminosilicate R, except that 6.91 kg of aluminate (18.0% $Na_2O$, 11.2% $Al_2O_3$, 70.8% $H_2O$) and 3.09 kg of silicate (8.0% $Na_2O$, 26.9% $SiO_2$, 65.1% $H_2O$) were used for the precipitation. The crystallization of the precipitation product was effected at 100° C. for 4 hours. After washing, the filter cake was dried for 24 hours at 100° C. and subsequently crushed to a fine powder. The product obtained, a feldsparoid hydrosodalite, had the following characteristics:

| | |
|---|---|
| Composition: | 1 $Na_2O$ . $Al_2O_3$ . 2.1 $SiO_2$ |
| Calcium binding power: | 16 mg CaO/gm of active substance |
| Average particle diameter: | 6.1 $\mu$ |

Preparation of aluminosilicate T

For the preparation of the aluminosilicate containing calcium ions, the 44% suspension of a crystalline sodium aluminosilicate of the composition $1.05Na_2O.Al_2O_3.1.93SiO_2$ was reacted with a concentrated calcium chloride solution. After filtering off the product laden with about 70% calcium, this process was repeated at 60° C. After drying, the product obtained had the following characteristics:

| | |
|---|---|
| Composition: | 0.05 $Na_2O$ . 0.94 CaG . $Al_2O_3$ . 1.92 $SiO_2$ |
| Active substance content: | 79% |
| Calcium binding power: | <15 mg CaO/gm of active substance |

Preparation of aluminosilicate U

For the preparation of the aluminosilicate containing magnesium ions, a 40% suspension of a crystalline sodium aluminosilicate of the composition $0.92Na_2O.Al_2O_3.2.39\ SiO_2$ was reacted with a concentrated magnesium sulfate solution at 80° to 90° C. for 30 minutes. After filtering off the product laden with magnesium, the treatment was repeated again. After drying, the product had the following characteristics:

| | |
|---|---|
| Composition: | 0.09 $Na_2O$ . 0.82 MgO . $Al_2O_3$ . 2.38 $SiO_2$ |
| Active substance content: | 78% |
| Calcium binding power: | <15 mg CaO/gm of active substance |

Preparation of aluminosilicate V

This aluminosilicate is a synthetic zeolite (Mordenite) where y has a value of >6 according to the above-mentioned formula. The preparation of these aluminosilicates is described more in detail in the monography by Donald W. Breck, "Zeolites, Molecular Sieves", Wiley & Sons, New York. The synthetic Mordenite is prepared from the reaction components sodium aluminate and silica, at temperatures between 265° and 295° C. for 2 to 3 days and yields a product of the following composition:

$$1.0Na_2O.Al_2O_3.10SiO_2.6.7H_2O$$

Other aluminosilicates, where y has a value of >6 according to the above-mentioned formula, are characterized below by commercial products.

Aluminosilicate W

Commercial amorphous aluminosilicate, type "Zeolex 23 A" by Huber Corp.

| | |
|---|---|
| Composition: | 1.5 $Na_2O$ . $Al_2O_3$ . 12.2 $SiO_2$ |
| Active substance content: | 82% |
| Calcium binding power: | 40 mg CaO/gm of active substance |

Aluminosilicate X

Commercial amorphous aluminosilicate type "Zeolex 35 P" by Huber Corp.

| | |
|---|---|
| Composition: | 1.5 $Na_2O$ . $Al_2O_3$ . 11.8 $SiO_2$ |
| Active substance content: | 82% |
| Calcium binding power: | 46 mg CaO/gm of active substance |

Aluminosilicate Y

Commercial amorphous aluminosilicate, type "Silteg P 820" by Degussa.

| | |
|---|---|
| Composition: | 1.1 $Na_2O$ . $Al_2O_3$ . 14.8 $SiO_2$ |
| Active substance content: | 80% |
| Calcium binding power: | 36 mg CaO/gm of active substance |

Aluminosilicate Z

Natural zeolite (Clinoptilolite), as it is obtained in large quantities in open pit mining in the Western part of the United States.

| | |
|---|---|
| Composition: | 0.6 $Na_2O$ . $Al_2O_3$ . 8.3 $SiO_2$ |

-continued

| | |
|---|---|
| Active substance content: | 86% |
| Calcium binding power: | 0 mg CaO/gm of active substance |

The following commercial products of the Anaconda Corp., Denver, Colorado, are additional examples of natural aluminum silicates that can be used according to the invention, for which y has a value of >6 according to the above-mentioned formula:

Anaconda, Natural Zeolite

Type 1010: molar ratio $SiO_2/Al_2O_3=9.8$
Type 2020: molar ratio $SiO_2/Al_2O_3=11.4$
Type 3030: molar ratio $SiO_2/Al_2O_3=9.0$
Type 4040: molar ratio $SiO_2/Al_2O_3=7.4$

EXAMPLE 1

Chrome Tanning of Furniture Leather

Dehaired cattle skins, limed, delimed, and bated in known manner were pickled after brief rinsing at 20° C. in the following manner (pickling and tanning jointly).

The dehaired skins were left running at 20° C. in the vat for 10 minutes with

100% water
7% common salt, i.e., sodium chloride

Subsequently 1.0% reaction product of adipic acid and dipropylene glycol (COOH:OH ratio of 2:1)
0.5% sulfuric acid (96% solution), or formic acid (85% solution)

were added, and the bath was operated for an additional 2 hours. Then, the dehaired skins were allowed to stand overnight in the bath (pH 3.8 through cross-section of skins). After an additional running time of 30 minutes, 2% of an electrolyte-resistant dubbin agent, based on sulfited natural oils, and
1% of an emulsifying agent, an anionic tenside, e.g., the ammonium salt of an alkyl sulfate with a $C_{12}$–$C_{18}$ chain were added, without changing the liquor, and the bath was operated for an additional time of 30 minutes. Then, 6% of a basic chrome tanning salt, e.g., Chromosal B® by Bayer AG were added, and the bath was run for 90 minutes. Subsequently, 3% aluminosilicate A was made, and the skins were treated for 4 hours in the vat. The aluminosilicates B, D, J, K, M, and P may each replace aluminosilicate A, with equally good, or substantially equally good, effect. The final pH of the liquor was 4.1 to 4.2. The residual chrome content of the liquor was 0.3 to 0.9 gm/l of chromium oxide. When the tanning is performed by the conventional chrome tanning process, the residual chrome content is, in contrast, 7 to 11 gm/l of chromium oxide.

The percentages for the pickling refer to pickling weight, and those for the tanning refer to the weight of the dehaired skins.

After completion, a leather was obtained that was soft like cloth and uniformly tanned, with a chrome content corresponding to 4.0% chromium oxide, based on leather with a 0% moisture content.

EXAMPLE 2

Chrome Tanning of Cattle Leather for Uppers

Dehaired cattle skins, limed, delimed and bated in known manner, were processed further (pickling and tanning simultaneously) after brief rinsing at 20° C.

The dehaired skins were left running at 22° C. in the vat for 10 minutes with

100% water
7% common salt (7.0 Baumé)

Subsequently, 0.7% of a mixture of technical grade aliphatic dicarboxylic acids (mainly adipic acid) and
0.7% sulfuric acid (96% solution)

were added, followed by an additional running time of 2 hours. Then, the dehaired skins were allowed to stand overnight in the bath (pH 3.7 through cross-section of skins). After an additional running time of 30 minutes, 5% of a basic chrome tanning agent (basicity 33%=1.25% chromium oxide, e.g., Chromosal B® by Bayer AG), were added, and left running for 90 minutes. Then, an addition of 2% reaction product of adipic acid and dipropylene glycol (COOH:OH ratio of 2:1)

was made, with additional running time of 90 minutes. Then 2.4% aluminosilicate H were added and treated again for 90 minutes, with slow heating to 35+ to 40° C.

The aluminosilicates C, F, L, U, W may be used instead of the aluminosilicate H with equally, or substantially equally, good results.

The end pH of the liquor is 4.1. The residual chrome content of the liquor is 0.33 gm/l of chromium oxide. However, the residual chrome content of a conventional tanning process, in contrast, is between 7 and 11 gm/l of chromium oxide.

A soft, full and supple leather for uppers, with a chrome content of 4.3% chromium oxide, based on leather with a 0% moisture content, was obtained after finishing.

EXAMPLE 3

Processing of Cattle Leather for Uppers

Dehaired cattle skins, limed, delimed, and bated in known manner, were processed further (pickling and tanning simultaneously) after brief rinsing at 20° C. The dehaired skins were first left running at 22° C. for 10 minutes in a vat with 100% water
7% common salt (7.0 Baumé).

Subsequently, 0.7% mixture of technical grade aliphatic dicarboxylic acid
0.7% sulfuric acid (96% solution), were added, with an additional running time of 2 hours. The pH of the skins was between 3.7 and 3.9. After an additional running time of 30 minutes, 0.5% emulsifying agent, an anionic tenside, for example, the ammonium salt of a $C_{12}$–$C_{18}$ alkyl sulfate were added, with an additional running time of 30 minutes. Then, 5.5% chrome tanning agent in form of a commercial, basic chrome tanning salt with about 25% $Cr_2O_3$ (e.g., Chromosal B®, Bayer AG.), 0.5% reaction product of adipic acid and trimethylolpropane (COOH:OH ratio of 5:3), were added, and left running for 100 minutes. Then 3% aluminosilicate P were added and treated again for 90 minutes under slow heating to 35° to 40° C. The end pH of the liquor was 4.2. The skins were allowed to stand in the liquor overnight, with occasional stirring.

The aluminosilicates A, E, G, L, N, R, V can be used instead of the aluminosilicate P with equally, or substantially equally, good results.

The residual chrome content of the liquor was 0.55 gm/l of chromium oxide, in contrast to a residual chrome content of 7 to 11 gm/l of chromium oxide for conventional tanning processes.

A leather of normal quality for uppers, with a chrome content corresponding to 4.1% chromium oxide, based on leather with a 0% moisture content, was obtained after conventional finishing.

EXAMPLE 4

Chrome Tanning of Cattle Leather for Uppers

Dehaired cattle skins, limed, delimed, and bated in known manner, were pickled by the following method, after brief rinsing at 20° C.:

The smoothed skins were allowed to run for 10 minutes at 20° C. in a vat with

100% water,

7% common salt (7.0 Baumé). subsequently, 0.6% formic acid, 0.7% sulfuric acid (96% solution)

were added, with an additional running time of 2 hours. Then, the skins were allowed to stand overnight in the bath (pH 3.8 through cross-section of skins). After further running time of 30 minutes without changing the liquor, an addition of 1% of an emulsifying agent, an anionic tenside, e.g., the ammonium salt of a $C_{12}$–$C_{18}$-alkylsulfate, was made with an additional running time of 30 minutes. Then, 5% of a basic, powdered chrome tanning agent (basicity 33%=1.25% $Cr_2O_3$), e.g., Chromosal B® by Bayer AG., were added and allowed to run for 90 minutes. Then, 2.4% aluminosilicate N, 2% reaction product of adipic acid and dipropylene glycol (COOH:OH ratio of 2:1)

were added, with subsequent treatment in the vat for 4 additional hours. The final pH of the liquor was 4.1 to 4.2. The aluminosilicates U, S, P, K, J, C, may be used instead of the aluminosilicate N with equally, or substantially equally, good results.

The residual chrome content of the liquor was 0.2 to 0.93 gm/l of chromium oxide, in contrast to the residual chrome content of 6 to 10 gm/l of chromium oxide for conventional chrome tanning.

Skins of a cloth-like softness that were uniformly penetrated by the tanning agent, with a chrome content correspondint to 4.2% chromium oxide, based on leather with a 0% moisture content, were obtained after conventional finishing.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. In the process of tanning for the production of leather comprising subjecting uncured hides to the action of an aqueous liquor containing (1) chemical tanning or pretanning agents, and (2) auxiliary chemicals to tanning and recovering leather, the improvement consisting essentially of employing (i) a water-insoluble aluminosilicate, containing bound water, of the formula $$(Cat_{2/n}O)_x \cdot AL_2O_3 \cdot (SiO_2)_y$$

wherein Cat represents a cation selected from the group consisting of alkali metals, bivalent metal ions, trivalent metal ions, and mixtures thereof; n represents an integer of from 1 to 3; x is a number of from 0.5 to 1.8; and y is a number of from 0.8 to 50, said aluminosilicates having an average particle size in the range of from about 0.1μ to 5 mm and a calcium binding power of from about 0 to 200 mg CaO/gm of anhydrous active substance measured at 22° C. according to the Calcium Binding Power Test Method, in combination with (ii) a carboxylic acid having at least two carboxyl groups and containing ester groups and/or urethane groups and/or amide groups, said carboxylic acids having a molecular weight of from about 200 to 30,000 and being water-soluble or water-dispersible, as partial replacement of said chemical tanning or pretanning agents and said auxiliary chemicals to tanning.

2. The process of claim 1 wherein the carboxylic acids have a molecular weight of from about 310 to 10,000.

3. The process of claim 1 wherein the carboxylic acids are obtained by reacting dicarboxylic acids or polycarboxylic acids, or mixtures thereof, with compounds containing hydroxyl groups, amino groups, or mixtures thereof, such that the molar ratio $$\frac{-COOH}{-NH/OH} \geqq 1 .$$

4. The process of claim 3 wherein the carboxylic acid is the reaction product of 2 mols of adipic acid and 1 mol of dipropyl glycol or of 5 mols of adipic acid and 3 mols of trimethylolpropane.

5. The process of claim 1 wherein the aluminosilicates and the carboxylic acids are used in combination with aliphatic and/or aromatic di- and/or tricarboxylic acids having from 2 to 8 carbon atoms in the chain and/or their water-soluble hydrolyzable partial esters with mono- or polyvalent alcohols having from 1 to 6 carbon atoms.

6. The process of claim 1 wherein Cat represents an alkali metal ion; x represents a number of from 0.7 to 1.5, and y represents a number of from 0.8 to 6, said aluminosilicates having a particle size of from about 0.1 to 25μ and a calcium binding power of from about 20–200 mg CaO/gm of anhydrous active substance.

7. The process of claim 6 wherein the alkali metal ion is a sodium ion and y represents a number of from 1.3 to 4, said aluminosilicates having a particle size of from about 1 to 12μ.

8. The process of claim 1 wherein Cat represents an alkali metal ion, x represents a number of from about 0.7 to 1.5, and y represents a number of from about 0.8 to 6, said aluminosilicates having a particle size of from more than 25μ to 5 mm and a calcium binding power of from about 20 to 200 mg CaO/gm of anhydrous active substance.

9. The process of claim 8 wherein the alkali metal ion is a sodium ion and y represents a number of from 1.3 to 4.

10. The process of claim 1 wherein Cat comprises at least 20 mol percent alkali metal ion, x represents a number of from 0.7 to 15, and y represents a number of from 0.8 to 6, said aluminosilicates having a particle size of from about 0.1$\mu$ to 5 mm and a calcium binding power of from about 20 to 200 mg CaO/gm of anhydrous active substance.

11. The process of claim 10 wherein the alkali metal ion is a sodium ion and y represents a number of from about 1.3 to 4.

12. The process of claim 1 wherein y represents a number of from about 0.8 to 6, said aluminosilicates having a Calcium Binding Power of from about 0 to <20 mg CaO/gm of anhydrous active substance.

13. The process of claim 12 wherein y represents a number of from about 1.3 to 4.

14. The process of claim 1 wherein y represents a number of from about more than 6 to 50.

15. The process of claim 1 wherein y represents a number of from about more than 6 to 20.

16. The process of claim 1 wherein Cat represents a sodium ion, an alkali earth metal ion, a zinc ion, an aluminum ion, or a mixture thereof.

17. The process of claim 16 wherein the alkali earth metal ion is a calcium or magnesium ion.

18. The process of claim 1 wherein the aluminosilicates have an at least partial acid-solubiity in the pH range of from 2.5 to 5 in the manufacture of leather.

19. The process of claim 18 wherein y represents a number of from about 1.3 to 20 and the aluminosilicates have an at least partial acid-solubility in the pH range of from 3.5 to 4.5.

20. The process of claims 18 or 19 wherein the aluminosilicates have a calcium binding power of from about 0 to <20 mg CaO/gm of anhydrous active substance.

21. The process of claims 18 or 19 wherein the aluminosilicates are characterized by the fact that they are at least partially dissolved by a solution of 2.5 ml of concentrated formic acid in 100 ml of water.

22. The process of claims 18 or 19 wherein the aluminosilicates are characterized by the fact that a suspension of 2 gm of aluminosilicate, based on the anhydrous active substance, in 100 ml of distilled water will produce within 8 to 30 minutes a pH above 2.5 after addition of 2 ml of concentrated formic acid, upon slow titration with agitation and at a temperature of 22° C.

23. The process of claim 22 wherein the suspension produces a pH between 2.5 and 5.5.

24. The process of claim 23 wherein the suspension produces a pH between 3.5 and 4.5.

25. The process of claim 1 wherein the carboxylic acids are added to the aqueous liquor in an amount of from about 1 to 20 gm/l of liquor.

26. The process of claim 1 wherein the aluminosilicates are added to the aqueous liquor in an amount of from about 10 to 50 gm/l of liquor, based on the anhydrous active substance.

27. The process of claim 1 which comprises the chrome tanning of leather.

* * * * *

UNITED STATES PATENT AND TRADEMARK OFFICE

CERTIFICATE OF CORRECTION

PATENT NO. : 4,264,319

DATED : April 28, 1981

INVENTOR(S) : JUERGEN PLAPPER et al.

It is certified that error appears in the above—identified patent and that said Letters Patent is hereby corrected as shown below:

Column 6, line 21: "solution" should read -- solutions -- line 22: Delete "s".

Column 15, line 23: "$A_2O_3 \cdot SiO_2 \cdot 2\ H_2O$" should read -- $Al_2O_3 \cdot 2\ SiO_2 \cdot 2\ H_2O$ --.

Column 15, line 24; Column 17, line 31, Column 19, line 53, Column 20, line 1: "Al-" should read -- $Al_2$- --.

Column 15, line 25; Column 17, line 32, Column 19, line 54; Column 20, line 2: Delete "$_2$", first occurrence.

UNITED STATES PATENT AND TRADEMARK OFFICE

CERTIFICATE OF CORRECTION

PATENT NO. : 4,264,319

DATED : April 28, 1981

INVENTOR(S) : JUERGEN PLAPPER et al.

It is certified that error appears in the above—identified patent and that said Letters Patent is hereby corrected as shown below:

Column 16, line 38: "1.35 kg" should read -- 13.5 kg --.

Column 19, line 60: "0.94 CaG" should read -- 0.94 CaO --.

Signed and Sealed this

*Third* Day of *November 1981*

[SEAL]

*Attest:*

GERALD J. MOSSINGHOFF

*Attesting Officer*

*Commissioner of Patents and Trademarks*